US006325058B1

(12) United States Patent
Farnworth

(10) Patent No.: US 6,325,058 B1
(45) Date of Patent: Dec. 4, 2001

(54) COMPLETE BLADE AND WAFER HANDLING AND SUPPORT SYSTEM WITHOUT TAPE

(75) Inventor: Warren M. Farnworth, Nampa, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/580,946

(22) Filed: May 30, 2000

Related U.S. Application Data

(62) Division of application No. 09/260,899, filed on Mar. 2, 1999, now Pat. No. 6,112,735.

(51) Int. Cl.[7] ..... B28D 1/02
(52) U.S. Cl. ..... 125/12; 451/287
(58) Field of Search ..... 125/12; 451/287–290, 451/388; 269/21

(56) References Cited

U.S. PATENT DOCUMENTS

| | | | | |
|---|---|---|---|---|
| 3,711,081 | | 1/1973 | Cachon . | |
| 3,823,836 | | 7/1974 | Cheney et al. . | |
| 4,183,545 | * | 1/1980 | Daly | 451/388 X |
| 4,553,069 | | 11/1985 | Purser . | |
| 4,597,228 | * | 7/1986 | Koyama et al. | 451/388 |
| 4,603,466 | | 8/1986 | Morley . | |
| 4,603,867 | * | 8/1986 | Babb et al. | 451/388 X |
| 4,747,608 | | 5/1988 | Sato et al. . | |
| 4,775,281 | | 10/1988 | Prentakis . | |
| 5,029,418 | * | 7/1991 | Bull | 451/388 X |
| 5,193,972 | | 3/1993 | Engelbrecht . | |
| 5,203,401 | | 4/1993 | Hamburgen et al. . | |
| 5,324,155 | | 6/1994 | Goodwin et al. . | |
| 5,411,921 | | 5/1995 | Negoro . | |
| 5,634,267 | | 6/1997 | Farnworth et al. . | |
| 5,649,854 | * | 7/1997 | Gill, Jr. | 451/290 |
| 5,655,954 | * | 8/1997 | Oishi et al. | 451/289 X |
| 5,679,055 | * | 10/1997 | Greene et al. | 451/286 X |
| 5,692,873 | | 12/1997 | Weeks et al. . | |
| 5,803,797 | | 9/1998 | Piper . | |
| 5,809,987 | | 9/1998 | Wark et al. . | |

* cited by examiner

*Primary Examiner*—Joseph J. Hail, III
*Assistant Examiner*—Anthony Ojini
(74) *Attorney, Agent, or Firm*—Thorp Reed & Armstrong, LLP

(57) ABSTRACT

The wafer handling and support system disclosed herein does not use tape and is adapted for use in conjunction with a number of work stations. The wafer handling and support system includes a chuck plate comprised of a non-porous section surrounding a porous section and a robotic arm for transporting a chuck plate/wafer combination under vacuum. The chuck plate is sized to be carried by a wafer chuck and the porous section of the chuck plate is configured to support a wafer. The wafer may be held in place on the chuck plate by the application of a vacuum.

13 Claims, 2 Drawing Sheets

COMPLETE BLADE AND WAFER HANDLING AND SUPPORT SYSTEM WITHOUT TAPE

This application is a divisional of prior U.S. application Ser. No. 09/260,899 filed Mar. 2, 1999 U.S. Pat. No. 6,112,735.

BACKGROUND OF THE INVENTION

1. Field of the Invention

The invention relates generally to wafer handling and support systems and, more specifically, to wafer handling and support systems which do not use tape.

2. Description of the Background

Many different types of semiconductor processing systems require the use of wafer handling systems or wafer support systems. Wafers are comprised of a number of integrated circuits or "dice". Through a dicing process, the dice are cut from the wafer. Traditionally, the dicing process is performed with wafer spindle and blade assemblies having circular cutting blades. Such devices may be obtained commercially from Disco Hi Tec America, Inc., Santa Clara, Calif. The cutting blades are oftentimes nickel-plated with a diamond grit cutting edge to allow for smooth cuts with a minimum amount of splintering of the wafer itself.

It is well known in the art to place the wafers on a surface, known as a "cutting chuck", where the wafers are diced by a cutting blade. During the dicing process, the cutting blade may cut through the wafer and into the cutting chuck itself. That damages the cutting blade, accelerates blade wear, and necessitates premature blade replacement to insure that wafers are not damaged during dicing.

To avoid cutting into the chuck, tape is used to hold the wafer in place on the cutting chuck during the dicing process. It is well known in the prior art to use a wafer frame and adhesive tape to maintain dice in place during the dicing process. The wafer frame is generally flat and defines an opening which is larger than the wafer. The adhesive tape is attached to the wafer frame and stretched across the opening. A wafer is secured to the adhesive tape within the opening, and the frame is secured, for example by a vacuum, to the cutting chuck for dicing. After the dice have been cut, the frame, along with the adhesive tape and the dice, are removed from the cutting chuck. The dice are separated from the adhesive tape, the adhesive tape is removed from the frame, and the frame is reused. The adhesive tape is known as "sticky back" and is usually a polymer based film such as polyvinyl chloride ("PVC"), with an adhesive coating on one side. The adhesive tape is usually about 3 mils thick. The dice stick to the adhesive, so that when the wafer is cut the dice remain in place on the cutting chuck and are not scattered. Because a cutting blade extends slightly below the wafer, the cutting blade is exposed to the adhesive tape. The adhesive binds to the cutting blade, causing accelerated blade wear and "gumming up" of the cutting blade. A gummed-up cutting blade reduces the effectiveness of the cutting blade, increases friction between the cutting blade and the wafer, and increases the tendency of the cutting blade to bind and break. Heat is generated from friction between the cutting blade and both the wafer and the adhesive. The faster the cutting blade is moved through the wafer, the more heat is generated, and that heat is increased when the cutting blade is gummed-up. In addition, the risk of the cutting blade binding increases as the temperature of the cutting blade increases. Furthermore, the silicon substrate may be damaged by the heat. As a result, the heat generated by the dicing process, and all of the undesirable side effects of the heat, limits the rate at which the cutting blade can be moved across a wafer. As the rate of the dicing processes decreases, the amount of time required to dice a wafer increases.

The accelerated wear and damage caused to cutting blades from contact with the chuck and the adhesive requires that they be replaced after dicing only about five or six wafers. Worn cutting blades lack exposure of the diamond particles to cleanly cut a wafer. The continued use of a worn cutting blade may result in damaged or totally destroyed wafers caused by a cutting blade breaking and spraying debris across the wafer. Replacing cutting blades is expensive not only in terms of the costs of the cutting blade, but also in terms of down time of the dicing process and interruption of the fabrication process while an old cutting blade is being removed and a new cutting blade is being installed.

Efforts have been made to design systems which do not require the use of tape. One such system is disclosed in U.S. Pat. No. 5,803,797. That patent discloses a patterned chuck with vacuum holes through the chuck to hold the die in place both during and after dicing. The patterned chuck has a plurality of recesses in its surface to accommodate the cutting blade. However, this requires that a special chuck be used for each type and size of die to be cut, as the plurality of recesses on each patterned chuck correspond to the particular type and size of dice to be cut.

Therefore there exists a need for an improved wafer handling system which reduces the amount of wear and damage to the cutting blade while allowing for efficient cutting and that is both economical and time efficient. More specifically, there is a need for a cutting chuck and adherence system that does not interfere with the cutting blade during dicing, but that secures a wafer onto the chuck without the need for a tape adhesive while proving to be cost effective and adaptable for use with a variety of wafers.

SUMMARY OF THE INVENTION

One aspect of the present invention is to provide a chuck plate, which includes a non-porous section surrounding a porous section. The chuck plate is sized to be carried by a wafer chuck. A wafer can be located on the porous section and held in place by the application of a vacuum. The chuck plate is then carried, for example, by a cutting chuck. Should the cutting blade extend through the wafer, the blade will cut the metallic porous section of the chuck plate such that damage to the blade is eliminated.

Another aspect of the present invention is to provide a cutting station, which includes: a chuck for supporting a wafer during singulation, a chuck plate carried by the chuck wherein the chuck plate includes a non-porous section surrounding a porous section, a cutting apparatus for cutting a wafer; and a vacuum in communication with the chuck.

Another aspect of the present invention is to provide a wafer handling and support system, which includes a chuck plate comprised of a non-porous section surrounding a porous section, and a robotic arm for transporting a wafer under vacuum. The robotic arm may include: a supporting arm capable of movement in the x, y and z directions, a forceps mechanism connected to the supporting arm and capable of movement in the z direction, and a vacuum wand connected to the supporting arm and in communication with a vacuum pump.

In accordance with another aspect of the present invention, a method is provided which includes the following steps: supporting a chuck plate with a chuck wherein the chuck plate comprises a non-porous section surrounding a porous section; positioning a wafer on the porous section of the chuck plate; applying a vacuum force to the wafer through the chuck and chuck plate; and singulating the wafer.

The present invention provides several advantages over prior art techniques. Yields are increased in comparison to systems that use adhesive tape. Yields are also increased in comparison to systems that require a specialized patterned chuck corresponding to each particular die to be cut. The method of the present invention may be carried out using much of the existing wafer handling equipment. Also, the life of the cutting blade is increased which, in turn, reduces the amount of down time of the dicing process and thus increases output. Those advantages and benefits, and others, will be apparent to those of ordinary skill in the art from the Description of a Preferred Embodiment, herein below.

BRIEF DESCRIPTION OF THE DRAWINGS

For the present invention to be readily understood and practiced, the invention will now be described, for purposes of illustration and not limitation, in conjunction with the following figures wherein.

DESCRIPTION OF A PREFERRED EMBODIMENT

Figure 1:
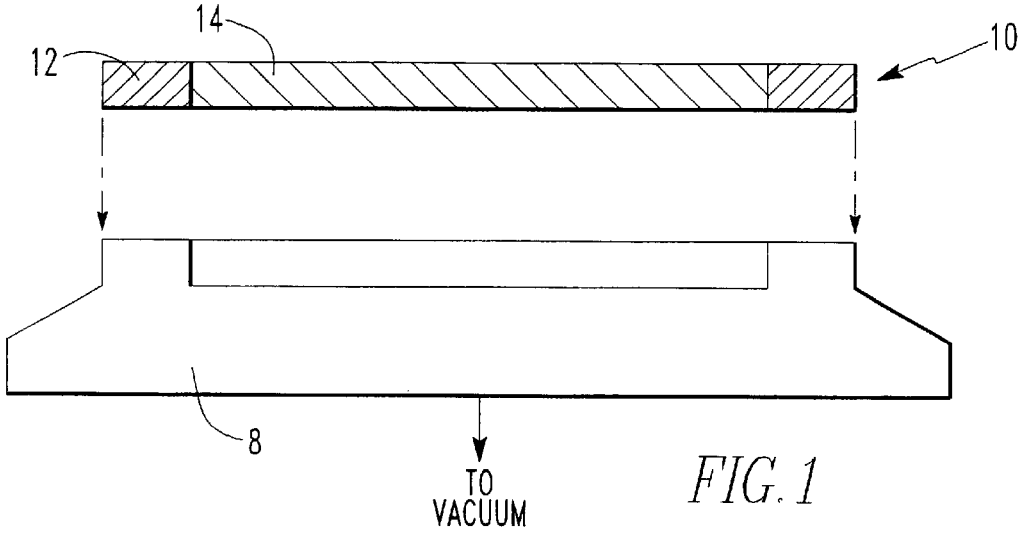
FIG. 1 is a cross-sectional view of a chuck plate constructed in accordance with the present invention in combination with a wafer chuck.

FIG. 1 is a cross sectional view of a chuck plate 10 constructed in accordance with the present invention in combination with a standard wafer chuck 8. The chuck plate 10 comprises a non-porous section 12 surrounding a porous section 14. The chuck plate 10, non-porous section 12 and porous section 14 are each preferably circular, although they may each also be other shapes. The chuck plate 10 is designed to support a wafer (not shown), wherein the wafer is preferably positioned so that the entire wafer rests on the porous section 14. The chuck plate 10 is designed to be positioned in combination with a standard wafer chuck 8 which standard wafer chuck 8 is attached to a vacuum pump. When a vacuum force is applied by the vacuum pump to the standard wafer chuck 8, that vacuum force is, in turn, applied to the chuck plate 10. The vacuum force passes through the porous section 14 of the chuck plate 10 which causes the wafer to be held securely to the porous section 14 of the chuck plate 10, thus allowing singulation of the wafer by a cutting apparatus. The porous section 14 provides for an evenly distributed vacuum force to pull and secure the wafer to the chuck plate 10.

The chuck plate 10 is preferably comprised of non-malleable metals, as malleable metals tend to gum-up the cutting blade. The preferable material of which porous section 14 is comprised may oftentimes depend upon the material of which the wafer is made. For example, if the wafer is comprised of silicon, a large amount of support is required to prevent the silicon wafer from falling down or "caving-in" during singulation. Therefore, porous section 14 is preferable comprised of a material with a lesser degree of porosity, that is, with a smaller number of holes per surface area. An additional consideration is the size of the holes which constitute porous section 14. Specifically, the holes of porous section 14 are preferably large enough to allow "cut" material and particles of the wafer produced as a by-product of singulation to be pulled from chuck plate 10 through porous section 14 and into a filter or screen (not shown). Otherwise, if the porosity of porous section 14 is too low, the particles may plug or block the holes of porous section 14, thus requiring a back-flow system to bubble off the by-product particles and materials from chuck plate 10.

Suitable materials from which the non-porous section 12 may be constructed include stainless steel or ceramics. Suitable materials of which the porous section 14 may be constructed include sintered metals such as stainless steel or porous sintered ceramic. The porosity of porous section 14 may range from 0.01% to 30%. Because of the porosity of porous section 14, it appears soft, at least softer than the wafer chuck 8, should it be struck by the cutting apparatus. Thus, wear and premature dulling of the cutting apparatus is avoided. Should the chuck plate 10 be cut to the point that it no longer provides adequate or proper support for the wafer being singulated, it may be turned over and the other side used as support for the wafer. Thus, the useful life of chuck plate 10 may be extended.

Figure 2:
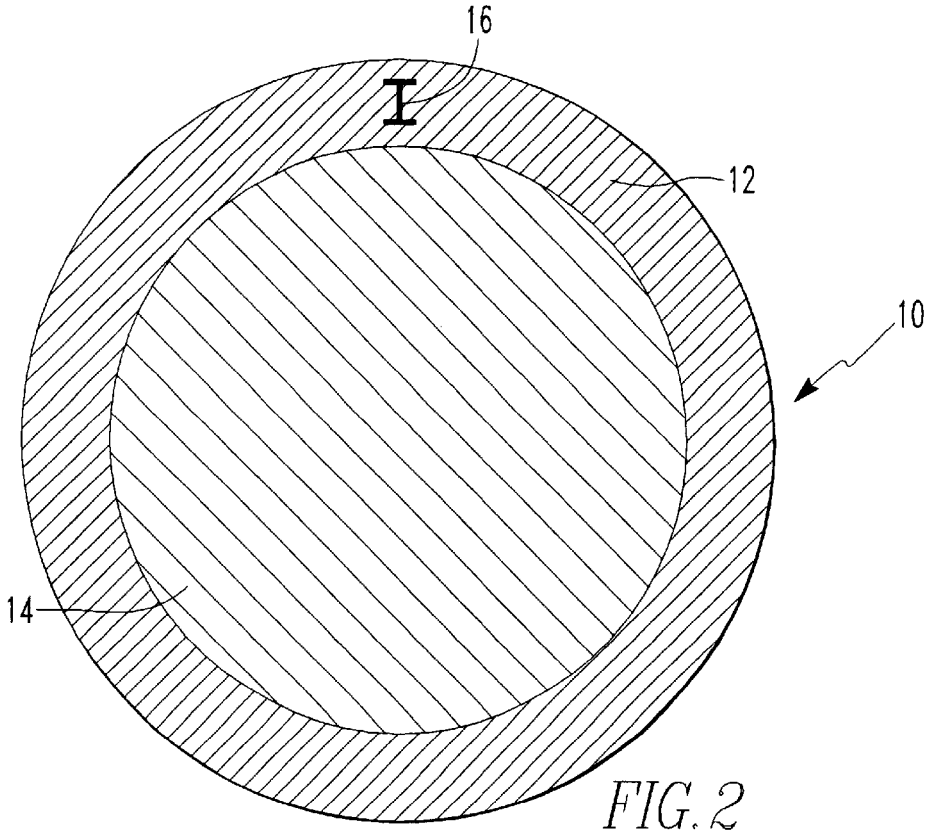
FIG. 2 is a top plan view of a chuck plate constructed in accordance with the present invention.

FIG. 2 is a top plan view of the chuck plate 10 constructed in accordance with the present invention. As shown, an orientation identifier or indicia 16 may be located on chuck plate 10. The orientation identifier 16 provides a mechanism by which to track the proper orientation of the wafer and die and to thus allow proper alignment during processing of the wafer after mapping. Any suitable identifier 16 may be used.

Figure 3:
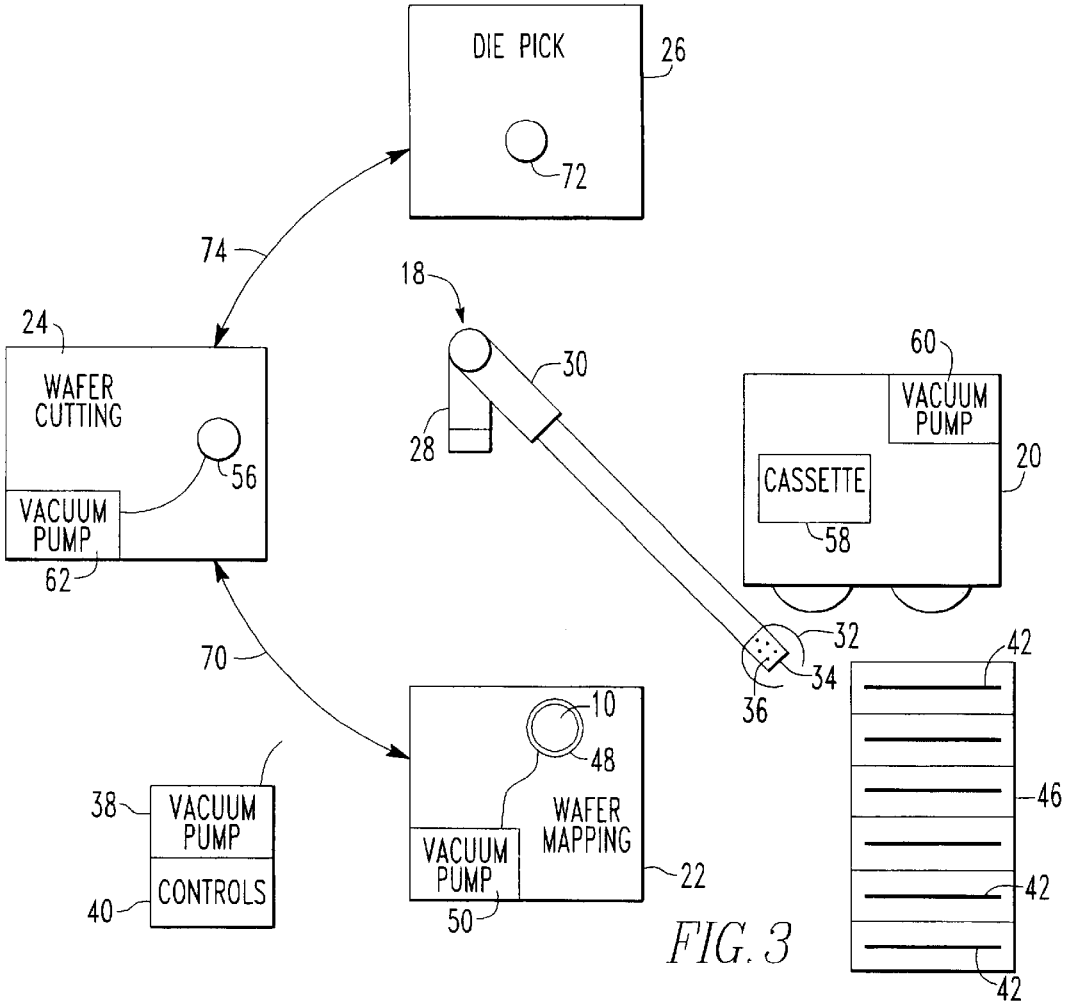
FIG. 3 is a schematic diagram of a wafer handling and support system constructed in accordance with the present invention and illustrated in conjunction with a number of work stations.

FIG. 3 a schematic diagram of a wafer handling and support system constructed in accordance with the present invention support system. Specifically, the wafer handling and support system comprises a robotic arm 18 and chuck plate 10. This wafer handling and support system, that is, the robotic arm 18 and chuck plate 10, may be used in conjunction with a number of workstations. The robotic arm 18 may be used for transporting the wafer and chuck plate 10 from the different stations of the processing system, that is, from a cassette holding station 20, a wafer mapping station 22, a wafer cutting station 24 and a die pick station 26. The robotic arm 18 may be comprised of a telescoping base 28 to which a telescoping supporting arm 30 is rotatably attached. At the end of supporting arm 22, various types of tools may be attached. Shown in FIG. 3 is a caliper-like forceps mechanism 32, capable of moving in the z direction, and a vacuum wand 34 having openings 36 therein.

Vacuum wand 34 is designed to be in communication with a vacuum pump 38. This allows a vacuum to be applied to the chuck plate 10/wafer combination during transportation from station to station. The supporting arm 30 is capable of movement in the x, y and z directions under control of control electronics 40. The forceps mechanism 32 is designed to be able to enclose around or grip the chuck plate 10 which is supporting the wafer. Once the forceps mechanism 32 grips the chuck plate 10, it moves upward in the z direction. Movement in the z direction may take place without a vacuum being applied to the chuck plate 10/wafer combination. The vacuum wand 34 may be placed directly below the chuck plate 10. The forceps mechanism 32 may then be lowered in the z direction so that the chuck plate 10 is positioned on the vacuum wand 34. The vacuum pump 38 serves to provide the necessary force to hold the chuck plate 10/wafer combination. If singulation has occurred, the vacuum is sufficient to hold the dice in place during movement of the support arm in the x and y directions.

The specific construction of the robotic arm 18 is not an important feature of the present invention. Those of ordinary skill in the art will recognize that many other configurations for robotic arm 18 are possible which will also provide the necessary degrees of freedom. The present invention is not intended to be limited to the specific construction of the robotic arm 18 shown in FIG. 3.

The interaction of the support arm 18 with the various stations 20, 22, 24 and 26, will be described in conjunction with FIG. 4. The manufactured wafer is fabricated with a large number of dice. The wafer is formed by patterning and doping a semi-conducting substrate and then depositing, patterning and etching various layers of material on the substrate to form integrated circuits.

A plurality of wafers 42 may be transported at step 44 by a cassette or wafer boat 46 to a position where robotic arm 18 may move a wafer 42 from cassette 46 to a chuck 48 within wafer mapping station 22. At step 44, it is not necessary to transport wafers 42 under a vacuum. Chuck 48 may have a chuck plate 10 preloaded thereon such that the wafer is positioned on chuck plate 10. In FIG. 3, chuck plate 10 is shown of smaller diameter than chuck 48 for purposes of illustration. Chuck plate 10 and chuck 48 will likely be of the same diameter. After wafer 42 is positioned on chuck plate 10, a vacuum is applied by vacuum pump 50. The wafer 42 is thus held to the chuck plate 10, and chuck plate 10 is held to chuck 48 by a vacuum.

Alternatively, the wafer mapping station 22 may be configured so that the wafer boat 46 carrying the wafers 42 may be loaded directly into the wafer mapping station 22. The mapping station 22 may be designed to allow each wafer 42 to be automatically loaded onto the chuck plate 10 for mapping. This configuration would eliminate the need for the robotic arm 18 to move each wafer 42 individually from cassette 46 onto the chuck plate 10 for mapping.

At station 22, the wafer is subjected to probe testing to ascertain the gross functionality of the dice contained on each wafer. Each dice is given a brief test for functionality and the nonfunctional dice are mechanically marked or mapped in software, at step 52. Mapping is carried out with respect to indicia 16. After mapping is carried out, the chuck plate 10 and wafer 42 are moved together, as a unit, at transport step 54. If wafer cutting station 24 is within reach of robotic arm 18, the robotic arm 18 may transport the chuck plate 10/wafer 42 unit and place them on a chuck 56 within wafer cutting station 24. If wafer cutting station 24 is not within reach of support arm 18, the chuck plate 10/wafer 42 unit is loaded in a cassette 58 of mobile cassette station 20. Before mobile cassette station 20 moves, a vacuum is applied to all the chuck plate 10/wafer 42 units held by the cassette 58 by a vacuum pump 60. Thereafter, the mobile cassette station 20 transports the chuck plate 10/wafer 42 units to a position where they may be loaded, under vacuum, into wafer cutting station 24.

Once the chuck plate 10/wafer 42 unit is positioned on chuck 56, whether directly from wafer mapping station 22 or from mobile cassette station 20, a vacuum is applied by vacuum pump 62 to the chuck plate 10/wafer 42 unit to keep the chuck plate 10 firmly in place with respect to chuck 56 and to keep the wafer 42 firmly in place with respect to the chuck plate 10. Once the vacuum has been applied by vacuum pump 62, the singulation process can begin at step 64. In the singulation process 64, the wafer 42 is cut so that the dice are separated. Before cutting of the wafer occurs, indicia 16 is used to properly orient the cutting apparatus with respect to the wafer 42. After the cutting operation, or singulation, is complete, one of three activities may take place.

Figure 4:
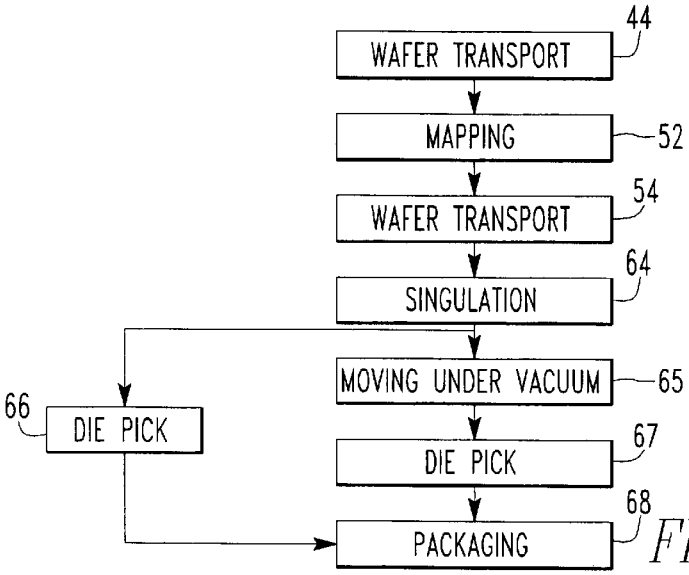
FIG. 4 is a block diagram illustrating the method of the present invention.

If wafer cutting station 24 has been provided with a die pick apparatus, the vacuum pump 62 may release the vacuum on chuck 56 and a die pick step performed as shown in step 66 in FIG. 4. During die pick, the dice having an acceptable gross functionality are picked up, usually one at a time, and moved to a sectioned plate, boat, or other holding apparatus (not shown) until packaging step 68 is performed. Because there is no tape, once the vacuum is released on chuck 56, the dice may be picked up easily with a very small vacuum force. Because there is no counterforce from the tape which must be overcome, not only is the process faster, but inadvertent breakage of dice is virtually eliminated. After the die pick step 66, the individual dice are then packaged in any conventional way as shown by step 68. Clearly, if the die pick step 66 is to be carried out at wafer cutting station 24, then the wafer mapping information obtained at wafer mapping station 22 must be made available to wafer cutting station 24 directly, or indirectly, as shown by line 70.

If wafer cutting station 24 is not provided with die pick equipment, and die pick station 26 is within range of robotic arm 18, then robotic arm 18 moves the chuck plate 10/wafer 42 unit, under vacuum at step 65, from wafer cutting station 24 to die pick station 26. The chuck plate 10/wafer 42 unit is placed on a chuck 72 within die pick station 26.

If wafer cutting station 24 is not provided with die pick equipment, and die pick station 26 is not within reach of robotic arm 18, then the chuck plate 10/wafer 42 unit is removed from wafer cutting station 24, under vacuum, and placed in mobile cassette station 20. Before mobile cassette station 20 moves, a vacuum is applied as previously discussed.

Once the chuck plate 10/wafer 42 unit is positioned on chuck 72, whether directly from wafer cutting station 24 or from mobile cassette station 20, the die pick operation may begin. Again, for the die pick operation to be carried out, information learned at the wafer mapping station 22 must be made available, either directly or indirectly, to the die pick station 26 as shown by line 74. The mapping information, together with the indicia 16, is used to control the die pick operation. As previously discussed, the die pick operation is simplified as a result of the present invention because there is no counterforce applied by an adhesive tape. As a result, the dice may be picked up from the chuck plate 10 with a minimum amount of force. There is no adhesive to be cleaned from the dice, and the chance of inadvertently breaking a dice by having to apply too much force to overcome the adhesive is completely eliminated. After the die pick operation is carried out at step 67, the dice are packaged as shown in step 68.

While the present invention has been described in conjunction with preferred embodiments thereof, those of ordinary skill will recognize that many modifications and variations thereof are possible. For example, chuck plate 10 may be comprised of a wide variety of materials as disclosed. Also, it is anticipated that the method of the present invention may be carried out using a variety of commercially available cassettes, wafer boats, wafer mapping, wafer cutting and die pick stations. Stations may be combined in various combinations and placed in various locations with respect to robotic arm 18 other than those shown in the figures. The foregoing description and the following claims are intended to cover all such modifications and variations.

What is claimed:

1. A station, comprising:

a chuck for supporting a wafer;

a chuck plate carried by said chuck, said chuck plate comprising an annular, non-porous section surrounding a porous section and wherein said porous section is sized to support a wafer such that the wafer does not come into contact with said annular, non-porous section;

a cutting apparatus for cutting a wafer; and a vacuum pump in communication with said chuck.

2. The station of claim 1 wherein said porous section is comprised of a material selected from a group consisting of sintered metal and sintered ceramic particles.

3. The station of claim 1 wherein the porosity of said porous section is sufficient to enable debris from a cutting operation to pass through said section.

4. The station of claim 1 further comprising a die pick apparatus.

5. The station of claim 1 wherein said annular, non-porous section is comprised of a material selected from the group consisting of stainless steel and ceramic.

6. A station, comprising:

a chuck for supporting a wafer;

a chuck plate carried by said chuck, said chuck plate comprising an annular, non-porous section surrounding a porous section and wherein said porous section is sized to support a wafer such that the wafer does not come into contact with said annular, non-porous section;

a mapping apparatus for wafer mapping; and a vacuum pump in communication with said chuck.

7. The station of claim 6 wherein said porous section is comprised of a material selected from a group consisting of sintered metal and sintered ceramic particles.

8. The station of claim 6 wherein the porosity of said porous section is sufficient to enable debris from a cutting operation to pass through said section.

9. The station of claim 6 wherein said annular, non-porous section is comprised of a material selected from the group consisting of stainless steel and ceramic.

10. A mobile station, comprising:

a cassette;

a chuck plate carried by said cassette, said chuck plate comprising an annular, non-porous section surrounding a porous section and wherein said porous section is sized to support a wafer such that the wafer does not come into contact with said annular, non-porous section;

a vacuum pump in communication with said cassette; and a mobile platform for carrying said cassette and said pump.

11. The station of claim 10 wherein said porous section is comprised of a material selected from a group consisting of sintered metal and sintered ceramic particles.

12. The station of claim 10 wherein the porosity of said porous section is sufficient to enable debris from a cutting operation to pass through said porous section.

13. The mobile station of claim 10 wherein said annular, non-porous section is comprised of a material selected from the group consisting of stainless steel and ceramic.

* * * * *